United States Patent [19]

Neely

[11] Patent Number: 4,489,451

[45] Date of Patent: Dec. 25, 1984

[54] SHEET TENT

[76] Inventor: Morrell Neely, 9011 S. Paxton, Chicago, Ill. 60617

[21] Appl. No.: 422,074

[22] Filed: Sep. 23, 1982

[51] Int. Cl.[3] ..... A47C 29/00

[52] U.S. Cl. ..... 5/414; 5/508; 5/504

[58] Field of Search ..... 5/413, 414, 416, 426, 5/498, 508, 512, 504

[56] References Cited

U.S. PATENT DOCUMENTS

| | | | |
|---|---|---|---|
| 364,415 | 6/1887 | Hooper | 5/414 |
| 875,206 | 12/1907 | Osborne | 5/414 |
| 1,708,855 | 4/1929 | Thompson | 5/414 |
| 1,732,716 | 10/1929 | Ealy | 5/414 |
| 1,833,298 | 11/1931 | Oakey | 5/498 |
| 2,737,193 | 3/1956 | Boyd | 5/414 |
| 3,606,622 | 9/1971 | Williams et al. | 5/498 |
| 4,214,327 | 7/1980 | Smith | 5/504 |
| 4,279,264 | 7/1981 | Gutner | 5/414 |

FOREIGN PATENT DOCUMENTS

| | | | |
|---|---|---|---|
| 899673 | 6/1962 | United Kingdom | 5/414 |

*Primary Examiner*—Alexander Grosz
*Assistant Examiner*—Michael F. Trettel
*Attorney, Agent, or Firm*—Laff, Whitesel, Conte & Saret

[57] ABSTRACT

A sheet tent for use with a bed. A sheet is provided with four reinforced holes. A frame having four posts extends upwardly from the bead for supporting the sheet. When the sheet is in place a fastener extends through the reinforced holes and it is received by bores in the top of the post. A means for removably fastening the sheet to the head and foot of the bed is provided. The sides of the sheet drape over the edges of the bed but are not fastened and thereby allow for circulation of air into the tent as well as a means of entering and exiting the bed.

5 Claims, 5 Drawing Figures

SHEET TENT

BACKGROUND OF THE INVENTION

The invention relates generally to accessories for use with beds and more specifically to means for providing privacy while sleeping.

In various situations it is desirable to provide privacy for people resting or sleeping in beds. Such situations include dormatories and barracks, where several people may reside and sleep in the same room, and hospitals where semi-private rooms and wards are prevalent.

Additionally, on a hot night, some people find it desirable to remove the sheet under which they are sleeping from next to their bodies, while at the same time, retaining the privacy afforded by sleeping under a sheet. The increased air circulation between the sheet and the body reduces the effects of perspiration, and increases the comfort of the individual while sleeping.

Previous attempts at providing privacy in such circumstances have included the use of movable free-standing screens and movable curtains which are suspended from the ceiling.

The use of free standing screens has significant shortcomings. First, the screens are rather bulky and are difficult to move around. Because of their considerable bulk and weight, any movement of the screens tends to be noisy and thus may disturb people nearby who are resting. Screens tend to be especially noisy in that, assuming that they completely surround the bed, they must be moved to the side to allow one to get into the bed and then closed back into the original position. Of course, this operation must be reversed upon leaving the bed. Further, the screens are usually not translucent and therefore do not transmit light from the periphery of the room, including windows. While this may be advantageous in those rare situations where the user is trying to sleep during the daytime, it obviates the possibility of reading in bed without the use of additional lighting. Further, the screens are rather expensive and require considerable investment, particularly if each neighbor in sleeping quarters is to be provided with such devices. Also, the screens are essentially flat, movable walls and can only be washed by manual labor using sponges, mops and buckets.

The second type of privacy enclosure presently used is a system of movable curtains or drapes suspended from the ceiling. These are often used in hospitals where they are specially installed during the construction of the ceiling of the room. While these are not as bulky and noisy as the use of screens, they do require considerable investment in the installation of a complicated system of tracks in the ceiling of the room in which they are to be used. Further, once the track is installed, the curtain may only be used in that exact location so that unlike the use of screens, the curtains cannot be readily moved from place to place. Such curtains may be machine laundered, but in such a case they must be removed from the track system. Such removal requires one to use a ladder to reach the track system and disengage the curtain. After machine laundering, one must again use a ladder to re-attach the drapes or curtains to the track system.

Therefore, it is an object of the present invention to provide a sheet tent to allow the privacy of people residing in bed which is light in weight and noiseless in use.

It is a further object of the present invention to provide a sheet tent which is inexpensive and may be washed by machine laundering.

It is yet another object of the present invention to provide a sheet tent which may be moved from place to place along with the bed.

It is a further object to provide a sheet tent that may be easily stored and transported.

It is still another object of the present invention to provide a sheet tent which allows for copious circulation of air around the body of the user and the transmission of some light to the interior of the bed.

SUMMARY OF THE INVENTION

In keeping with one aspect of the invention a sheet tent is constructed with a sheet with four small reinforced holes. A frame with four posts for supporting the sheet extends upwardly from the bed. A bore is provided in the end of each post. A fastener extends through the holes defined by the sheet and is received by the bores at the end of the post. Means are provided for removably fastening the sheet to the foot of the bed and additional means are provided for removably fastening the sheet to the head of the bed.

The above mentioned and other features of this invention and the manner of obtaining them will become more apparent and the invention itself will be best understood by reference to the following description of the embodiment of the invention taken in conjunction with the accompanying drawings.

DETAILED DESCRIPTION OF THE INVENTION

Figure 1:
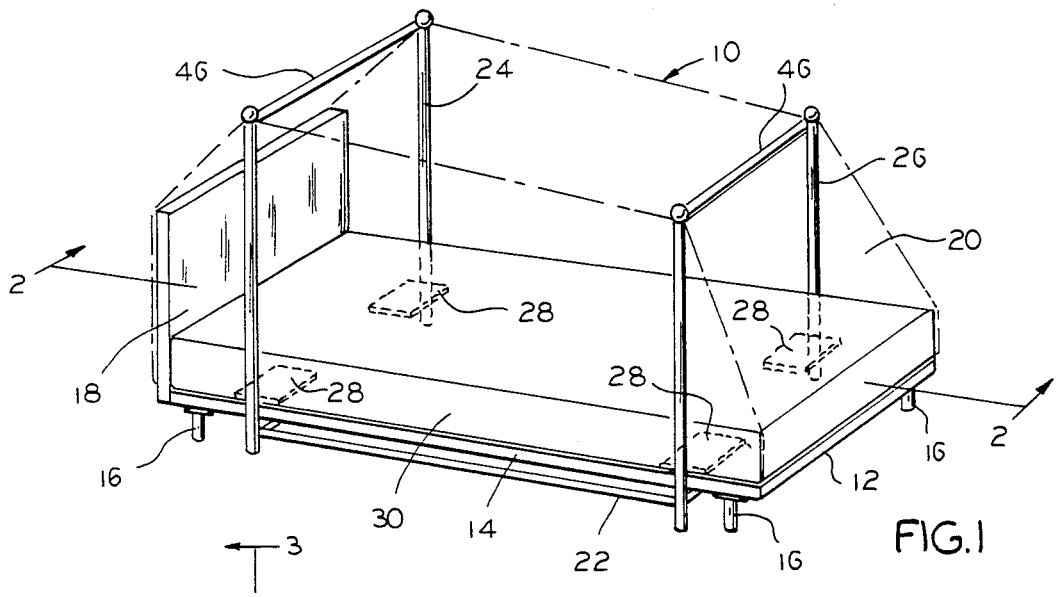
FIG. 1 is a perspective view of the invention.

As shown in FIG. 1 a sheet tent constructed in accordance with the teachings of this invention is designated with reference numeral 10. The invention is used in conjunction with a bed 12 which has a bed frame 14 with legs 16. The bed also has a headboard 18. Of course, the invention would be suitable for use with beds having more elaborate box springs and also having a foot board or no head board. The sheet 20 (shown in phantom) generally extends over and along the sides of the bed. It is supported by the support frame 22, head poles 24 and foot poles 26 which extend substantially vertically and are located near, but not at, the four corners of the bed.

The support frame 22 can be constructed of conventional materials such as welded angled iron. The support poles may be welded to the frame or secured by fasteners.

Figure 4:
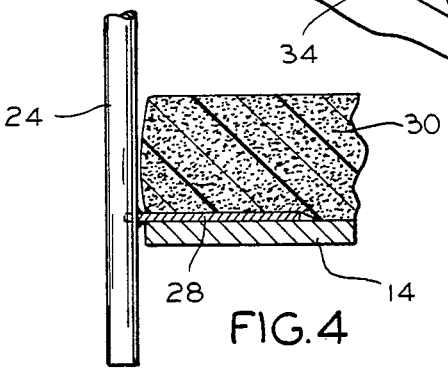
FIG. 4 is a cross-sectional view along line 4—4 of FIG. 2 showing a cross-sectional view of the post, mattress, and frame according to one embodiment of the present invention.

FIG. 4 especially shows an alternative means of attaching the poles 24 and 26 to the bed 12. A horizontally extending plate 28 is attached near the bottom of each pole 24, 26 by means of welding, threaded fasteners, or the suitable means. As can be seen in FIGS. 1 and 4, the plate 28 is placed along the length of the pole 24, 26 so that the lower end of each pole rests on the floor when the plate is inserted between the mattress 30 and bed frame 14. Each plate 28 could also be attached to poles 24, 26 by means of thumb screws which clamp the plates to each corresponding pole. In this way, the location of the plates could be varied to allow its use with beds having frames of different heights.

Figure 5:
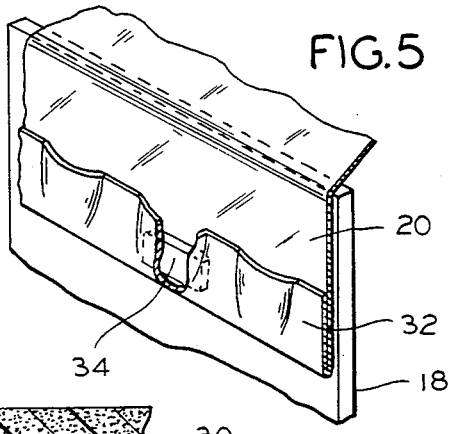

FIG. 5 shows the preferred method of anchoring sheet 20 at headboard 18. The sheet 20 is provided with either one or a series of pockets 32. The pockets are open at the top surface and are adopted to receive weights 34. The sheet 20 is draped over the headboard 18 such that the weighted edge of the sheet provides a force to pull the sheet taut. The weights are preferrably relatively flat so that they may be used in situations where the headboard 18 of the bed 12 is closely adjacent to a wall.

Alternately, the end of the sheet 20 could be doubled over and stitched to provide a long cylindrical pocket in the sheet with one or both ends open. In that case, a rod could be inserted to provide the necessary weight. In either of these constructions the weights can be removed to allow ease of laundering when the sheet 20 is washed. Alternatively, the weights could be sewn in place.

Figure 3:
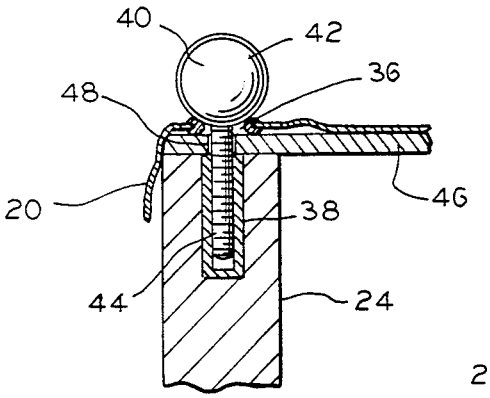
FIG. 3 is a cross-sectional view along line 3—3 of FIG. 3 showing an enlarged detail of the upper end of the pole.

FIG. 3 shows the structure at the top of the posts 24, 26 where the sheet 20 is attached to the posts. The sheet 20 is provided with holes 36. The holes 36 should be reinforced with stitching or by other means to prevent tearing. Each pole 24, 26 is provided with an internally threaded bore 38. Each fastener 40 has a spherical grip 42 and a threaded shaft 44. The sheet 20 is attached at the top of the post by inserting the shafts 44 through holes 36, and then threading shaft 44 into the bores 38.

Alternately, bores 38 and shafts 44 may be smooth and without threads, whereby each shaft 44 is dropped into a bore 38 after being inserted through a hole 36 in sheet 20.

The posts 24, 26 may be braced at the top by means of a cross brace 46 (FIG. 3) which may run across the top of the headpoles 24, 26. Cross brace 46 could be fixedly attached to each pole by means of welding or ther conventional means, removably fixed thereto with threaded fasteners or the like. In the embodiment illustrated in FIG. 3, the cross brace is provided with an aperture 48 through which the shaft 44 is inserted, and into the bore 38 to secure the cross brace 46. In FIG. 3, the cross brace 46 is shown positioned under the sheet 20 and thus will support the sheet along the length of the brace.

Figure 2:
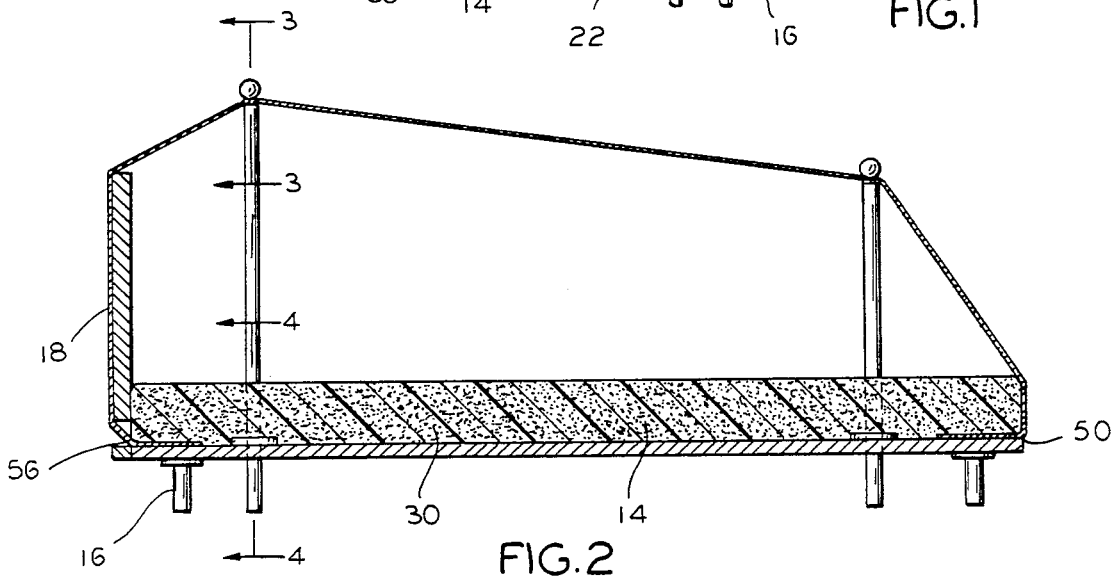
FIG. 2 is a cross-sectional view of the invention taken along line 2—2 of FIG. 1.

As can best be seen in FIG. 2, the sheet 20 can be attached to the foot of the bed 12 by tucking it in under the mattress 30 and thereby trapping it between the mattress 30 and the frame, as shown at reference numeral 50. Alternately, the sheet 20 could be attached to the foot of the bed 12 by means of metal hooks which attach to the mattress 30. Further, Velcro fasteners could be used to attach the sheet 20 to the foot of the mattress 30. In situations were there is no headboard, or the use of weights is not desirable, the head end of sheet 20 could be attached to the top of the head end of the mattress by tucking (as shown in FIG. 2 at reference numeral 52), hooks, or Velcro fasteners.

In the preferred embodiment of the present invention, the sides of the sheet are not attached to the bed or mattress, but are allowed to hang freely, almost to the level of the floor. This permits air to circulate around and under the sides of the sheet tent and thus provide cooling and ventilation to the interior of the sheet tent. Further, the occupant may enter or leave the bed by the sides without fastening or unfastening the sheet from any fixed location.

The sheet tent of the present invention is easy to install in association with any standard bed 12. Posts 24, 26 are set up surrounding the bed 12. The sheet 20 is unfoled on top of the poles 24, 26 so that the weighted end hangs over the head of the bed. The optional cross brace 46 may be positioned between the poles 24, 26 and the sheet. The fasteners 40 are inserted through the holes in the sheet 20 and the cross brace 46, and are received in each corresponding bore 38. If the bore 38 and shaft 44 are threaded, the fastener 40 must be rotated into position. One end of the sheet tent is then attached to the foot of the bed 12.

Removal of the sheet tent is accomplished by reversing the steps stated above. If the sheet is to be laundered, the weights 34 should first be removed.

The sheet tent 10 constructed in accordance with the above description provides an economical, easily assembled unit which can be easily laundered. It provides privacy for theuser, with good ventilation. Since the sheet can be constructed from translucent cotton, linen, or artificial fabrics, some degree of light transmission is expected. This will allow the user to read in bed if desired.

While the principles of the invention have been described above in connection with specific apparatus and applications, it is to be understood that this description is made only by way of example and not as a limitation on the scope of the invention.

I claim:

1. A sheet tent, for use with a bed supported by a support surface, having a head and foot comprising:

(a) a sheet including a plurality of holes therein;

(b) vertically extending posts disposed adjacent said bed for supporting said sheet, said posts extending at one end thereof to said supporting surface;

(c) fastening means extending through the holes defined by the sheet and being adopted to be attached to the tops of each of said posts;

(d) means for removably fastening the sheet to the foot of the bed;

(e) a means for removably fastening the sheet to the head of the bed, whereby the sides of said sheet hang loosely over the sides of said bed, and said sheet is supported at a distance over said bed;

said bed including a mattress and a horizontal surface to support the mattress, and wherein said posts each include a plate attached thereto and extending between said mattress and said horizontal surface to thereby additionally support said posts in a substantially vertical position.

2. The invention according to claim 1 where said bed includes a head board, and the means for attaching the sheet to the head of the bed includes a pocket defined by the sheet and removable weight means placed in the said pocket to form a weighted end of said sheet such that said weight means exert a force on said sheet when the weighted end of said sheet is draped over the said head board.

3. The invention according to claim 1 including cross brace means extending between the tops of said posts.

4. The invention according to claim 1 wherein the means for attaching the sheet to the foot of the bed includes hooks located on the sheet which are received by said mattress.

5. The invention according to claim 1 wherein said sheet in constructed of the translucent material to allow transmittal of light to the interior of the said sheet tent.

* * * * *